US005195437A

United States Patent [19]

Wallace et al.

[11] Patent Number: 5,195,437

[45] Date of Patent: Mar. 23, 1993

[54] CONVEYOR SYSTEM

[75] Inventors: Gregory M. Wallace, Evansville, Ind.; David M. Horton, Henderson, Ky.

[73] Assignee: George Koch Sons, Inc., Evansville, Ind.

[21] Appl. No.: 775,119

[22] Filed: Oct. 11, 1991

[51] Int. Cl.[5] ..... B61B 10/04

[52] U.S. Cl. ..... 104/172.3; 104/172.2; 104/252

[58] Field of Search ..... 104/99, 172.2, 172.3, 104/172.5, 249, 250, 252; 198/465.1, 465.2, 803.01, 345.3

[56] References Cited

U.S. PATENT DOCUMENTS

| | | | |
|---|---|---|---|
| 2,619,916 | 12/1952 | Rainier | 104/172.3 |
| 3,130,685 | 4/1964 | Goodrich et al. | 104/172.2 |
| 4,644,869 | 2/1987 | Rhodes | 104/172.2 |
| 4,746,005 | 5/1988 | Bihary et al. | 198/465.1 |
| 4,944,228 | 7/1990 | Rhodes | 104/172.2 |

FOREIGN PATENT DOCUMENTS

| | | | |
|---|---|---|---|
| 18099 | of 1911 | United Kingdom | 104/252 |

*Primary Examiner*—Robert J. Oberleitner
*Assistant Examiner*—Kevin D. Rutherford
*Attorney, Agent, or Firm*—Barnes & Thornburg

[57] ABSTRACT

A conveyor system for transporting wheeled trucks along a roadway that has straight and curved portions, in the center of which lies a chain conveyor. The trucks selectively engage the chain so as to be impelled thereby to move along the roadway and are supported on four wheel casters that traverse the roadway. The trucks have an upper turntable surface which can rotate in 90° segments as the trucks follow around a corner of the roadway. The turntable is rotated by a four arm cross-lever connected to the turntable below the truck and non-rotatable with respect to the turntable. Turntable turning assemblies located adjacent the roadway, extend upward from the roadway to engage an arm of the four arm cross-lever to rotate the turntable as the truck encounters the turntable turning assembly. A tow pin hangs from the trucks and can be actuated to separate it from the chain to stop the truck by two different lifting mechanisms. One mechanism is located at the rear of a truck so as to stop the truck behind it if it gets too close. The second is a pivoting arm located in the roadway which can be powered to disconnect the tow pin. The truck has a tail pin that rides in the roadway to steer the truck as it turns corners. The chain has a roller guide on the inner side of the curves for support.

20 Claims, 4 Drawing Sheets

CONVEYOR SYSTEM

BACKGROUND AND SUMMARY OF THE INVENTION

The present invention relates to a conveyor system utilized to move wheeled trucks along a predetermined pathway. In particular, the trucks have a tow pin which can be lowered into engagement with a driver on the chain. The wheels of the trucks ride on a roadway on both sides of a track housing a chain and are guided to follow the track. The chain track turns corners in a building and the truck follows in alignment with the chain. On top of the truck is a turntable which can be rotated. Automatic turning mechanisms on the roadway are provided for rotating the turntable 90° through coaction with a four-armed, cross-lever mounted through the truck and non-rotatably attached to the turntable. Two types of chain disengagement mechanisms are provided to raise the tow pin on the truck. One is a pivotal disengagement cam lever located on the roadway and the other is a trailing disengaging cam fork on another truck which automatically disengages the tow pin on the adjacent truck before a rear-end collision between the two trucks can take place.

A chain conveyor system for transporting items of manufacture between work stations in a building is shown in U.S. Pat. No. 4,702,174 to Tredwell, et al issued Oct. 27, 1987 and the DeBorgh U.S. Pat. Nos. 2,317,675 of Apr., 1943 and 2,640,607 of Jun., 1953 cited therein. The conveyor in the Tredwell, et al patent requires lifting of the work surface of the truck prior to its rotation. Additionally, a manual foot lever on the truck is utilized to disengage the chain drive. Also disengagement ramps are periodically located along the roadway to automatically disengage the trucks from the chain drive. Re-engagement occurs when a predetermined number of trucks abut each other at a way-station and a new truck tries to enter the way-station. The incoming truck, by contact with the truck ahead, starts a chain reaction that pushes the first truck out of the way-station to again be moved by the chain drive.

The aforementioned Tredwell, et al system is set up so that the trucks have to collide with one another and additionally that one truck cannot be released to be driven by the chain until the way-station is filled. Also the mechanism for turning the top loading surface of the trucks requires the lifting thereof and this rotation is caused by impacting the loading surface with a fixed unyielding turning bar. Additionally, there is no selective disengagement of the drive train from the truck. The disengaging cams are fixed on the roadway and disconnect the drive whenever the truck reaches a cam.

Also, there is nothing provided in Tredwell, et al to keep a truck from rear-ending the truck ahead of it that has been stopped by disconnection of its drive to the chain. Quite to the contrary, Tredwell requires a series of rear-enders at a way-station as the necessary requirement to push a truck out of the way-station so that it can again be engaged by the drive chain.

This invention is directed to improving the conveying system of the Tredwell, et al patent by avoiding the above disadvantages.

Accordingly, it is an object of this invention to provide a selectively actuable disconnect for uncoupling a truck from the chain at a particular point along the track when desired, while permitting the truck to remain connected to the drive at that particular point if that is the desire.

Another object of the invention is to provide an anti-rear-end collision control to automatically disengage a following truck from the chain drive in order to keep it from rear-ending a stopped truck ahead of it.

Another object of the invention is to provide a turning mechanism for the work surface of a truck which does not require lifting of the work surface before turning.

A still further object of the invention provides for a cushioned mechanism to rotate the work surface of the truck without jarring.

Another feature of the invention is the provision of special turning track sections to provide for a smooth movement of the truck about a curve in the track.

The above objects are obtained by providing the trucks with a tow pin hanging down from the truck and spring biased downward to rest in the path of a driver tang on the chain. Engagement of the tow pin with the tang causes the tang to act as a pusher to move the truck along the track. Here an upper portion of the drive pin engages in the truck to keep the front of the truck in alignment with the tang. A tail guide pin also engages the track, but is too short to engage the drive tang on the chain. The tail pin keeps the rear of the truck in alignment with the guide track. Caster wheels on the truck rest on a roadway on each side of the track to support the truck and allow it to be driven forward when the tow pin is engaged by the tang. The fact that the wheels are on casters allows the truck to follow curves in the track.

In order to avoid excessive wear and jamming of the chain, the inside curves of the track have vertically aligned rollers to engage the chain and keep it in alignment with the truck while at the same time reducing friction of the track and the chain at the corners.

In order to provide the selective disengagement of the trucks from the drive train at desired locations along the track, pivoted disengagement cam levers are provided along the track. Normally these cams are in a withdrawn position. When it is desired to disengage the truck from the chain drive, the disengagement cam lever at the desired disconnect location is energized. Energizing of the disengagement cam lever causes it to be raised. The tow pin on each truck has a lower circular cam surface which comes into contact with the disengagement cam lever when the disengagement cam lever is in its raised position. This contact causes the disengagement cam lever to engage the lower circular cam surface and lift the tow pin (in opposition to its downwardly biasing spring) to a point above the drive tang on the chain, whereupon the truck will cease to be driven by the chain. When it is again desired to drive the truck by the chain, the disengagement cam lever is released and drops to its withdrawn position. The bias spring then forces the tow pin downward so that the tang on the chain can then engage the tow pin to push the truck along the track.

The invention also contemplates utilizing an automatic anti-rear-end collision control to disconnect the drive of a following truck should it get too close to the truck ahead of it. To this end, each truck has a disengagement camming fork at its rear-end. The tow pin on each truck also has a second and upper circular cam surface on it. This second cam surface will engage the rearwardly extending camming fork of the truck ahead of it, should the trucks get too close (approximately within two inches of one another, but any separating distance can be selected). Engagement of a rearwardly extending camming fork with the second camming surface causes the tow pin to be raised in a similar fashion as when the first camming surface thereon is engaging the pivoting disengagement cam lever. The cam fork will thus raise the tow pin to a point where it no longer is engaged by the driving tang on the chain and hence the drive to the truck (second in line) will be disconnected so that it will not rear-end the truck ahead of it. Thus, the invention allows for the stopping of one truck by the pivoting of a disengagement cam lever and insures following trucks will not rear-end it.

As the truck negotiates a turn, or even on straightaway track sections, it is sometimes desirable to reorient goods on the truck 90°. This could occur for a painting operation, an assembly operation, etc. To this end, each truck is equipped with a turntable top. This top has a rotator spindle shaft fixedly connected to its center. The rotator shaft extends downward through an opening in the truck so as to be rotatable with respect to the truck. At a bottom end of the shaft are a first set of two arms, extending in a straight line and oriented at 180° from one another. Above this set of arms is an additional set of two arms, extending in a straight line and oriented at 180° from one another and at 90° from the first set of arms. Turntable turning assemblies are located adjacent points along the track where rotation is desired. The turntable turning assemblies have a cam surface in line with one of the two sets of arms and can engage one of the arms that extends at right angles to the path of travel of the truck. When an arm engages the cam surface it is restrained from movement. As the truck proceeds down the track the turntable turning assembly causes the restrained arm to pivot about its axis 90°, thus rotating the turntable 90°. On the top side of the truck and facing the turntable there is a spring biased detent that engages in one of four detent holes, spaced 90° around the underside of the turntable. This detent holds the turntable in one of four angular positions with respect to the truck.

By having two sets of arms and turntable turning assemblies at two different heights, the turntable turning assemblies can be closer together along the track, since the upper set of spindle paddle arms can pass over the lower turning cam surface. Thus 180° rotation can occur in a short distance along the track.

Likewise, by having the two cam surfaces of the tow pin at different heights, either one can be actuated independently of the other and jamming between a trailing disengaging cam fork or pivoting disengaging cam lever cannot occur.

Other objects, advantages and novel features of the present invention will become apparent from the following detailed description of the invention when considered in conjunction with the accompanying drawings.

DETAILED DESCRIPTION OF THE DRAWINGS

Figure 1:
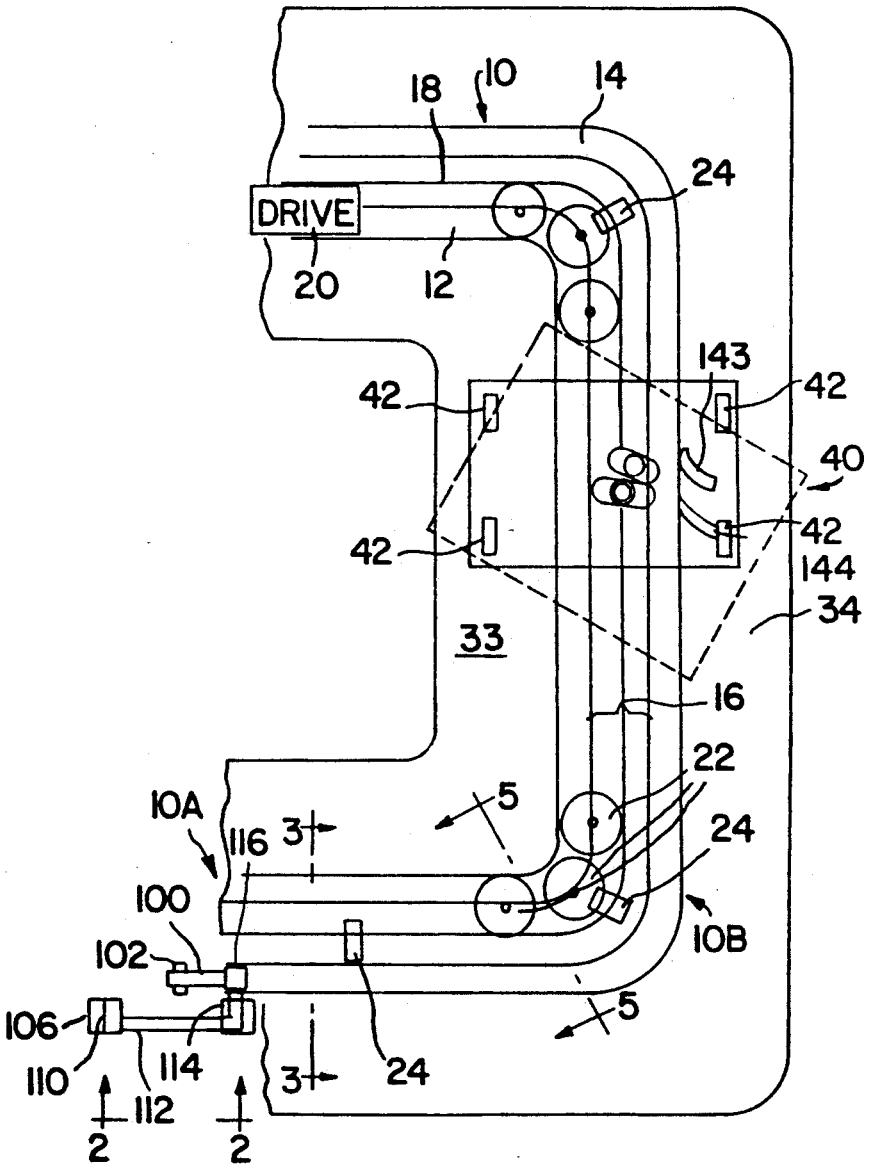
FIG. 1 is a plan view schematic of a section of guide track (partially in section) with a truck at a turning station.
Figure 3:
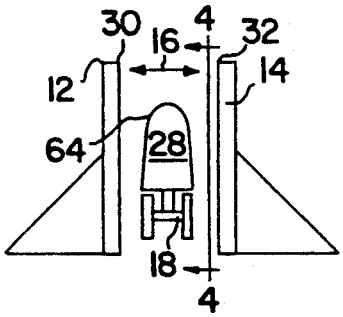
FIG. 3 is a cross-sectional view of a straight section of track taken along the line 3—3 of FIG. 1.

FIG. 1 shows a section of track 10 which has inner and outer walls 12, 14 spaced apart from one another by a gap distance 16 (FIG. 3). A drive chain 18 traverses the track 10 and is driven by a sprocket motor 20. The track has straight sections 10A and curved sections 10B. On the curved sections 10B, the inside wall 12 contains guide idle rollers 22 for guiding the chain around the curves. If necessary similar guide rollers (not shown) can also be placed along long sections of the straight track for keeping the chain in alignment in the gap 16 between the inner and outer walls 12, 14.

Figure 4:
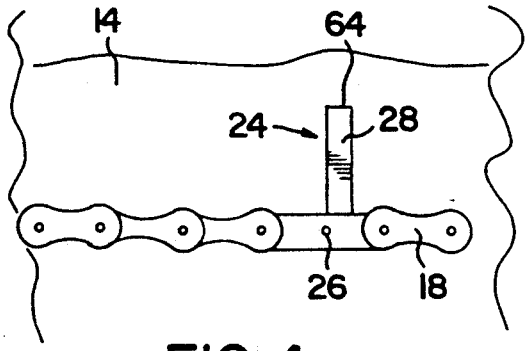
FIG. 4 is a side view of a section of the chain drive and driver tang taken along the line 4—4 of FIG. 3.
Figure 5:
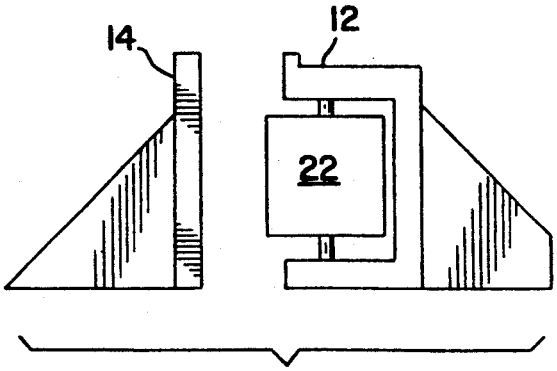
FIG. 5 is a cross-sectional view of a curved section of track taken along line 5—5 of FIG. 1.

Driver tangs 24 (for instance in FIG. 4) are attached at periodic points to the chain drive 18 by chain links 26 and have a driver surface 28 (FIGS. 3 and 4) extending upward in direct alignment with the gap 16 and below the upper edges 30, 32 of the inner and outer walls 12, 14. These driver tangs 24 impart movement to the wheeled trucks 40 in a manner to be explained later on.

Figure 6:
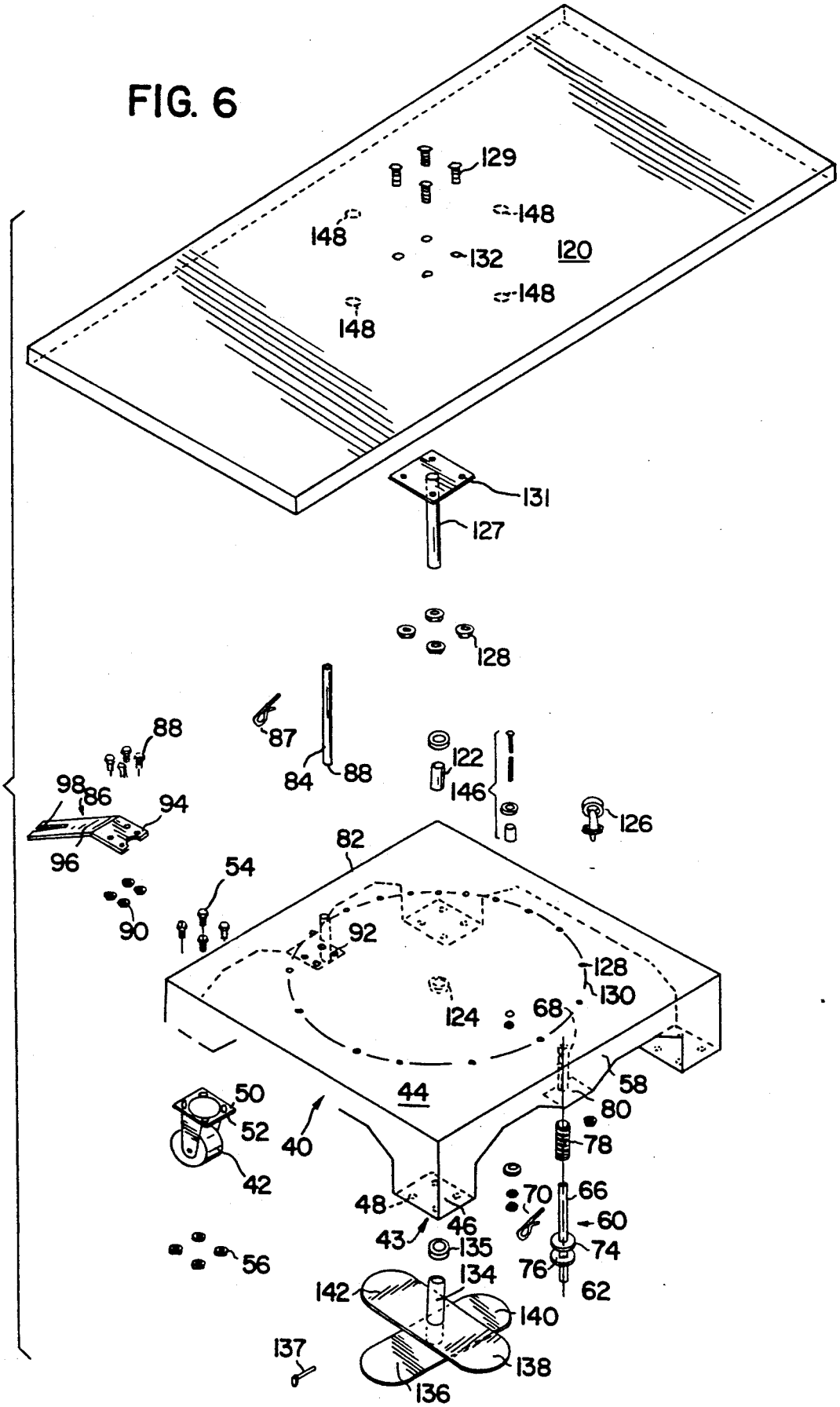
FIG. 6 is an exploded three-dimensional view of the truck.
Figure 7B:
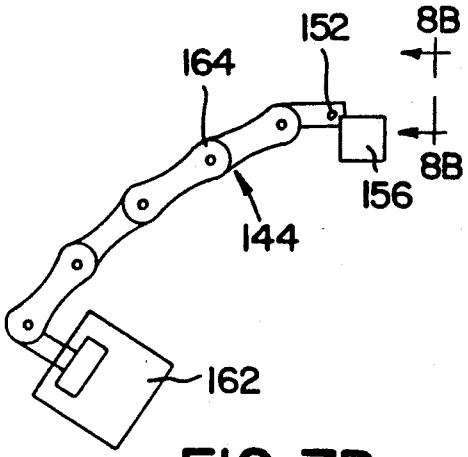
FIGS. 7A and 7B are plan views of the two types of turntable turning assemblies utilized to turn the turntable of the truck.
Figure 9:
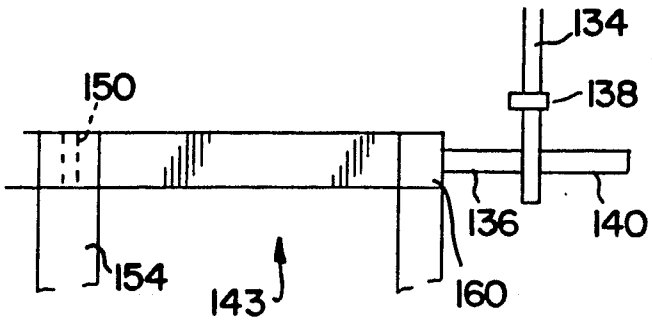
FIG. 9 is an elevated view of FIG. 8A.
Figure 7A:
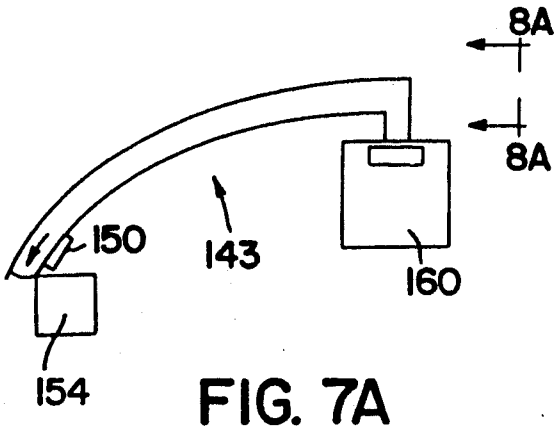
Figure 8B:
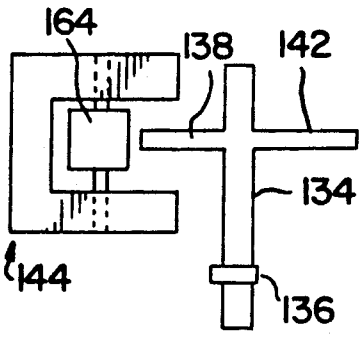
FIGS. 8A and 8B are cross-sectional views of the turntable rotation cam surfaces of FIGS. 7A and 7B.
Figure 8A:
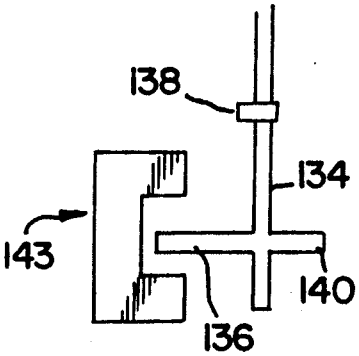

The wheeled trucks 40 (see FIG. 6) roll on wheels 42 on a floor that has an inner roadway 33 (FIG. 1) and outer roadway 34 located inwardly and outwardly (in plan view) of the inner and outer walls 12, 14. Each truck 40 has four wheels 42, one at each corner 43 of the truck bed 44 (FIGS. 1 and 6). Each corner 43 of the truck bed 44 has a depending flat surface 46 with four holes 48. Each wheel 42 is of the caster type and has an axle support flange 50 with four holes 52. The flange 50 is bolted to the flat surface 46 of the corner 43 of the truck 40 by four bolts 54 and nuts 56.

Extending downwardly at the center of the front edge 58 of the truck bed 44 is a tow pin 60 (FIG. 6) which has its lowest portion 62 normally extending into the gap 16 between the inner and outer walls 12, 14 and below the upper edge 64 of the driver surface 28. The tow pin 60 has its upper portion 66 received in a cylindrical fitting 68 at the center front of truck bed 44. A cotter pin 70 extends through the upper portion 66 of the tow pin 60 above truck bed 44. Tow pin 60 has upper and lower circular cam surfaces 74, 76 thereon. A bias spring 78 surrounds the upper portion 66 of the tow pin 60. The spring 78 is located between the bottom shelf 80 of the truck and the upper cam surface 74. The spring bias thus forces the tow pin 60 downwardly to a position where cotter pin 70 engages the top of truck bed 44 and the lower end 62 of the tow pin 60 is within the gap 16 between the inner and outer walls 12, 14, above the chain drive 18 and below the top edge 64 of the surface 28 of the driver tang 24.

Mounted centrally in the truck bed 44, near the rear edge 82, is a tail pin 84 secured to the truck bed 44 by cotter pin 87. This tail pin extends downward to enter the gap 16 but has it lowest end 88 terminate above the driver surface 28. The passage of the tail pin 84 and the tow pin 60 into the gap 16 between the inner and outer walls 12, 14 causes the truck bed 40 to stay in alignment with the track as the driver surface 28 engages the lower portion of tow pin 60 to push the truck along the track 10. Hence the caster wheels 56 will remain and rotate on the inner and outer roadways 32, 33.

Depending downward and rearward from the truck bed 44 (adjacent to the guide pin 84) is a trailing disengaging cam fork 86 which is attached to the truck bed 44 via four bolts 88 and nuts 90 through holes 92 in the truck bed 44 and holes 94 in the disengaging cam fork 86. The rear ramp surface 96 of the disengaging cam fork 86 slopes downwardly and has a V-slot 98 opening outward from the rear of the truck bed 44. If a truck 40 is stopped on the track 10 and is approached by a moving second truck 40, the V-slot 98 of the disengaging cam fork 86 of the stopped truck will trap the tow pin 60 of the moving second truck as the moving second truck gets close to the first truck. The V-slot 98 entraps pin 60 at a point between the two circular cam surfaces 74, 76 and just below the upper circular cam surface 74. Continued forward movement of the moving second truck 40 will cause the upper cam surface 74 of tow pin 60 to ride up the rear ramp surface 96 of the disengaging cam fork 86 to lift tow pin 60 of the moving second truck so that its end 62 is above the upper surface 64 of the drive tang 24 driver surface 28 on the chain 18. At this point the moving second truck 40 will stop short of the truck 40 stopped ahead, since no driving force to the moving second truck 40 through its tow pin 60 occurs. Thus, the upward camming of upper circular cam 74 of tow pin 60 by the V-shaped disengaging cam fork 86 automatically prevents "rear-ending" of one truck by another.

Figure 2:
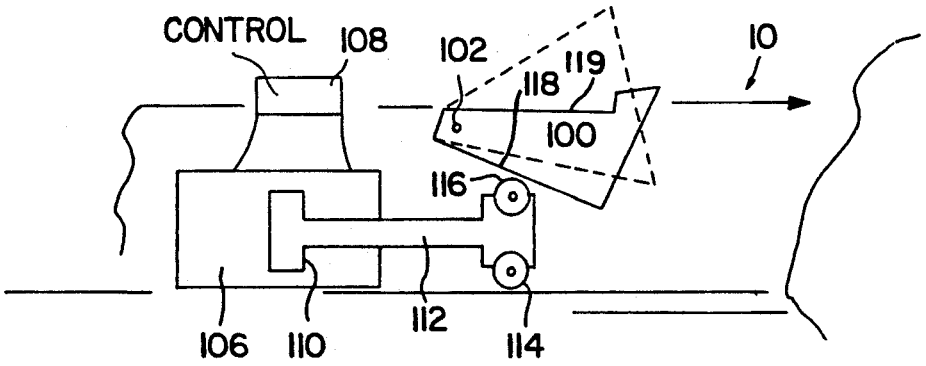
FIG. 2 is a side detail of the disengagement pivoting cam lever taken along the line 2—2 of FIG. 1.

A pivotal disengaging cam lever 100 (left bottom FIG. 1 and FIG. 2) is provided for disconnecting the tow pin 60 from the driver surface 28 of the driving tang 24. Here the disengaging cam lever 100 is a section of one of the track walls 12, 14 and is pivoted about pivot 102. Below the disengaging cam lever 100 is a piston-cylinder 106 controlled by a valve controller 108 to cause the piston 110 to move horizontally to the left or right. Movement to the right carries piston rod 112 to the right. At the end of piston rod 112 are two rollers 114, 116. The lower roller 114 rolls along one of the roadways 32, 33 and the upper roller 116 rolls under the pivotal disengaging cam lever 100. As the piston rod 112 moves to the right, the upper roller 116 cooperates with lower surface 118 of disengaging cam lever 100 to pivot the disengaging cam lever 100 upward (dotted position FIG. 2). As a truck 40 moves around track 10, the lower circular cam surface 76 will engage upper cam surface 119 when raised by roller 116 acting on lower cam surface 118. Continued movement of truck 40 will cause the tow pin 60 to raise upwardly as the circular cam surface 62 rides up upper cam surface 119 of the pivotal disengaging cam lever 100 to cause the lower end 62 to be raised above the upper edge 64 of driver surface 28 of the driver tang 24 to disconnect the drive to the truck 40.

The truck 40 has a rotatable turntable 120 mounted through a bushing assembly 122 resting on a collar 124 in truck bed 44. A plurality of rollers 126 (only one is shown in FIG. 6) are mounted in holes 128 located in a circle 130 about the upper surface of the truck bed 44 to support the rotatable turntable 120. The top of spindle 127 is attached to the turntable 120 by bolts 129 and nuts 128 extending through holes 131 and 132. The spindle 127 extends through bushing 122 and is connected to lower spindle shaft 134 by clevis pin 137. Lower spindle shaft 134 has four turn paddle arms 136, 138, 140, 142 attached thereto at 90° increments around the lower spindle shaft 134. Arms 138 and 142 are aligned and located above aligned arms 136, 140. Turntable turning assemblies 143, 144 (see FIG. 1 and FIGS. 7-9) are located on the track adjacent the outer wall 14 to impart rotation to one of the paddle arms 136, 138, 140, 142 as a truck passes by. These turntable turning assemblies 143, 144 are fixed on the roadway 34. Arm 144 is higher than arm 143 and in line with top paddle arms 138, 142 while arm 143 is aligned with paddle arms 136, 140. As a truck 40 moves past one of the turntable turning assemblies 143, 144 the appropriate paddle arm 136, 138, 140, 142 that is extending at right angles to the track 10 has its outer edge blocked from forward motion along the track 10 by the turntable turning assembly 143, 144. As the truck 40 continues to move along track 10, the blocked arm will follow the path of the turntable turning assembly 143, 144 causing the turntable to rotate 90°. To limit rotation of the turntable to 90°, a spring detent assembly 146 (comprising a spring biased pin) is mounted on the truck bed 44 to engage in one of four holes 148 on the underside of the turntable 120 and hold the turntable 120 at, that position. The action between the turntable turning assemblies 143, 144 and the paddle arms 136, 138, 140, 142 can overcome the force of the detent assembly to allow rotation.

To avoid shocks to the turntable, each of the turntable turning assemblies 143 and 144 are hinged at 150, 152 (respectively) to supports 154, 156 with the other ends mounted in a spring loaded dashpot 160, 162 to absorb shocks at engagement. The turntable turning assembly 143 is shown in cross-section as a U-shaped member to capture paddle arms 136, 140, or it can have rollers 164 thereon as shown in arm 144. By having the paddle arms 136, 138, 140, 142 at different heights, a trailing paddle arm cannot hit a turntable turning assembly that has caused the proceeding paddle arm to turn the turntable 120. Also two turntable turning assemblies 143 and 144 can be placed close together along the track 10 to provide an almost continuous 180° turntable turn without one paddle arm 136, 138, 140, 142, hitting an upstream turntable turning assembly 143, 144.

Thus it can be seen that trucks can be disconnected from the track at desired locations by the pivotal disengagement cam lever 100, can be automatically protected from rear-end collisions by V-shaped disconnection cam fork 86 and can have a rotatable turntable top 120 automatically indexed 90° by turntable turning assembly 143, 144.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. An endless conveyor system comprising:

individual wheeled trucks supported to roll on a floor, each truck having:

a truck bed for supporting carried articles;

depending drive means having a lower portion extending below said truck bed;

said lower portion having a first and second cam surface thereon;

a guide track mounted on the floor;

an endless drive means in said track;

said endless drive means having a plurality of driver means connected thereto for imparting movement to said depending drive means on each truck;

said depending drive means being movable between a first position in which a lower end thereof lies in a plane of the driver means to contact the driver means, to a second position in which the lower end of the depending drive means avoids the plane of the driver means;

a movable disengagement means attached to the floor to contact the first cam surface and move the depending drive means to the second position;

an actuator means for moving the moveable disengagement means to an actuated position and wherein said moveable disengagement means normally rests in a non-actuated position;

control means for moving said actuator means to cause said disengagement means to move to its actuated position, wherein there is a second disengagement means for contacting the second cam surface on the depending drive means on each truck to move the depending drive means to avoid the plane of the driver means; and wherein the second disengagement means automatically disengages the depending drive means of a truck from the driver means just before the truck comes into contact with another truck just ahead of it to avoid the truck from having a rear end collision with another truck.

2. The endless conveyor of claim 1 wherein the depending drive means comprises a tow pin that extends from the truck and is biased by a spring into its first position;

wherein the disengagement means comprises a pivoted cam lever that is mounted to the floor adjacent the track; and wherein the disengagement means contacts said first cam surface on the tow pin to move the tow pin against its spring bias when the disengagement means is moved to its extended position.

3. The endless conveyor system of claim 2 wherein the actuator means comprises a hydraulic piston-cylinder wherein a piston cams the movable disengagement means to its actuated position upon extension of the piston in a cylinder.

4. The endless conveyor system of claim 1 wherein the actuator means comprises a hydraulic piston-cylinder wherein a piston cams the movable disengagement means to its actuated position upon extension of the piston in a cylinder.

5. The endless conveyor system of claim 1 wherein the guide track has straight sections and curved sections;

wherein the endless drive means is a chain;

wherein guide roller means are located in the curved sections of the guide track on inside portions of the guide track to guide the chain as it traverses the curved sections of the guide track.

6. The endless conveyor of claim 1 wherein the second disengagement means comprises a cam fork means that engages the second cam surface to move it to its disengage position.

7. The endless conveyor of claim 6 wherein the cam fork means is extended from under the rear of another truck bed to contact the second cam surface of the depending drive means of the truck to move the depending drive means to its disengaged position when the truck gets too close to the other truck.

8. The endless conveyor system of claim 1 wherein the truck has a rotatable top;

wherein there is a rotatable spindle means that depends downwardly from the rotatable top; and rotation means located on the floor for rotating the spindle means to rotate the rotatable top.

9. The endless conveyor system of claim 8 wherein the spindle has arm means extending radially outwardly and wherein the rotation means is stationary and has contact surface means that come into contact with the arm means to impart a force to the spindle to rotate the rotatable top as a truck is driven past the rotation means by the driver means.

10. An endless conveyor system comprising:

individual wheeled trucks supported to roll on a floor, each truck having:

depending drive means;

a guide track mounted on the floor;

an endless drive means in said track;

said endless drive means having a plurality of driver means connected thereto for imparting movement to said depending drive means on each truck;

said depending drive means being movable between a first position in which it lies in a plane of the driver means to contact the driver means, to a second position in which the depending drive means avoids the plane of the driver means;

a movable disengagement means attached to the floor to contact and move the depending drive means to the second position;

an actuator means for moving the moveable disengagement means to an actuated position and wherein said moveable disengagement means normally rests in a non-actuated position;

control means for moving said actuator means to cause said disengagement means to move to its actuated position, wherein the actuator means comprises a hydraulic piston-cylinder wherein a piston cams the movable disengagement means to its actuated position upon extension of the piston in a cylinder, wherein the piston has plural rollers on its end with one roller engaging a cam surface on the movable disengagement means and the other being supported on the floor.

11. An endless conveyor system comprising:

individual wheeled trucks supported to roll on a floor, each truck having:

depending drive means;

a guide track mounted on the floor;

an endless drive means in said track;

said endless drive means having a plurality of driver means connected thereto for imparting movement to said depending drive means on each truck;

said depending drive means being movable between a first position in which it lies in a plane of the driver means to contact the driver means, to a second position in which the depending drive means avoids the plane of the driver means;

a movable disengagement means attached to the floor to contact and move the depending drive means to the second position;

an actuator means for moving the moveable disengagement means to an actuated position and wherein said moveable disengagement means normally rests in a non-actuated position;

control means for moving said actuator means to cause said disengagement means to move to its actuated position, wherein the depending drive means comprises a tow pin that extends from the truck and is biased by a spring into its first position;

said tow pin having a cam surface;

wherein the disengagement means comprises a pivoted cam lever that is mounted to the floor adjacent the track; and wherein the disengagement means contacts said cam surface on the tow pin to move the tow pin against its spring bias when the disengagement means is moved to its extended position;

wherein the piston has plural rollers on its end with one roller engaging a cam surface on the movable disengagement means and the other being supported on the floor.

12. An endless conveyor system comprising:

individual wheeled trucks supported to roll on a floor, each truck having a depending drive means;

a truck bed for supporting carried articles;

a depending drive means having a lower portion extending below the truck bed and having a first and second cam surface on the lower portion;

a guide track mounted on the floor;

an endless drive means in said track;

said endless drive means having a plurality of driver means connected thereto for imparting movement to the lower portion of said depending drive means on each truck;

said depending drive means being movable between a first position, in which a lower end thereof lies in a plane of the driver means to contact the driver means, to a second position in which the depending drive means avoids the plane of the driver means;

a first movable disengagement means attached to the floor to contact the first cam surface and move the drive means to the second position;

an actuator means for moving the disengagement means to an actuated position to move the depending drive means;

control means for moving said actuator means to cause said disengagement means to move to its actuated position;

wherein there is a second disengagement means for the depending drive means on each truck to automatically contact the second cam surface and move the depending drive means on another truck to avoid the plane of the driver means and thus avoid a collision between two trucks which get too close to one another.

13. The endless conveyor of claim 12 wherein the second disengagement means comprises a cam fork means that engages the second cam surface to move it to its disengaged position.

14. The endless conveyor of claim 13 wherein the cam fork means is attached to the another truck to extend rearwardly of the another truck and under the truck to contact the second cam surface of the depending drive means of the truck to move the depending drive means to its disengage position when the truck gets too close to the another truck.

15. An endless conveyor system comprising:

individual wheeled trucks supported to roll on a floor, each truck having a depending drive means;

a truck bed for supporting carried articles;

the depending drive means having a lower portion extending below the truck bed and having a first and a second cam surface on the lower portion;

a guide track mounted on the floor;

an endless drive means in said track;

said endless drive means having a plurality of driver means connected thereto for imparting movement to said lower portion of said depending drive means on each truck;

said depending drive means being movable between a first position in which a lower end thereof lies in a plane of the driver means to contact the driver means to a second position in which the depending drive means avoids the plane of the driver means;

first movable disengagement means attached to the floor to contact the first cam surface and move the depending drive means to the second position;

an actuator means for moving the disengagement means to an actuated position to move the depending drive means;

control means for moving said actuator to cause said disengagement means to move to its actuated position;

a second disengagement means on said truck to contact the second cam surface and move a depending drive means on a following truck when the following truck gets close to the truck ahead of it to avoid a collision therewith;

wherein the truck has a rotatable top;

wherein there is a rotatable spindle means that depends downwardly from the rotatable top; and rotation means located on the floor for rotating the spindle means to rotate the rotatable top.

16. The endless conveyor system of claim 15 wherein the spindle has arm means extending radially outwardly and wherein the rotation means is stationary and has contact surface means that comes into contact with the arm means to impart a force to the spindle to rotate the rotatable top as a truck is driven past the rotation means by the driver means.

17. The endless conveyor system of claim 16 wherein the truck has a spring biased detent means that cooperates with an underside surface of the turntable to restrain the turntable from freely rotating.

18. The endless conveyor system of claim 15 wherein the truck has a spring biased detent means that cooperates with an underside surface of the turntable to restrain the turntable from freely rotating.

19. An endless conveyor system comprising:

individual wheeled trucks supported to roll on a floor, an endless drive means in said track; each truck having a depending drive means;

a guide track mounted on the floor;

said endless drive means having a plurality of driver means connected thereto for imparting movement to said depending drive means on each truck;

said depending drive means being movable between a first position in which it lies in a plane of the drive means to contact the driver means to a second position in which the depending drive means avoids the plane of the driver means;

first movable disengagement means attached to the floor to contact and move the depending drive means to the second position;

an actuator means for moving the disengagement means to an actuated position to move the depending drive means;

control means for moving said actuator to cause said disengagement means to move to its actuated position;

wherein the truck has a rotatable top;

wherein there is a rotatable spindle means that depends downwardly from the rotatable top; and rotation means located on the floor for rotating the spindle means to rotate the rotatable top, wherein the spindle has plural arm means located on the spindle at least at two different heights from the floor;

wherein there are plural rotation means with one rotation means having its contact surface at one of the two different heights from the floor to contact with at least one of the plural arm means and another rotation means has its contact surface at the other of the two different heights from the floor to contact with another of the plural arm means.

20. The endless conveyor system of claim 19 wherein the truck has a spring biased detent means that cooperates with an underside surface of the turntable to restrain the turntable from freely rotating.

* * * * *